United States Patent [19]

Masaki

[11] Patent Number: 4,812,059

[45] Date of Patent: Mar. 14, 1989

[54] PRINTER APPARATUS WITH AUTOMATIC GAP ADJUSTING MECHANISM

[75] Inventor: Hideo Masaki, Tokyo, Japan

[73] Assignee: Kabushiki Kaisha Toshiba, Kawasaki, Japan

[21] Appl. No.: 112,879

[22] Filed: Oct. 27, 1987

[30] Foreign Application Priority Data

Oct. 31, 1986 [JP] Japan ..... 61-259732

[51] Int. Cl.[4] ..... B41J 11/20

[52] U.S. Cl. ..... 400/56; 400/59; 318/696

[58] Field of Search ..... 400/55, 56, 57, 58, 400/59, 60, 902, 903; 318/696, 685; 368/157

[56] References Cited

U.S. PATENT DOCUMENTS

| | | | |
|---|---|---|---|
| 4,203,678 | 5/1980 | Nordstrom et al. | 318/685 X |
| 4,340,848 | 7/1982 | Hanagata et al. | 318/685 X |
| 4,540,927 | 9/1985 | Tanimoto | 318/696 |
| 4,652,153 | 3/1987 | Kotsuzumi et al. | 400/56 |
| 4,676,675 | 6/1987 | Suzuki et al. | 400/56 |

FOREIGN PATENT DOCUMENTS

| | | | |
|---|---|---|---|
| 53465 | 3/1983 | Japan | 400/59 |
| 148786 | 9/1983 | Japan | 400/55 |
| 212373 | 10/1985 | Japan | 400/56 |
| 171377 | 8/1986 | Japan | 400/59 |

*Primary Examiner*—Charles Pearson

*Attorney, Agent, or Firm*—Finnegan, Henderson, Farabow, Garrett, & Dunner

[57] ABSTRACT

A printer apparatus including a timer, for setting a period T1 when the print head moves forward toward a platen, and a period T2, which is longer than period T1, when the print head moves away from the platen. In response to an interrupt signal from the timer, a CPU supplies a signal, for changing over the exciting phase of the stepping motor, to a motor driving circuit. As a result, the motor driving circuit operates to speed up the rotation of the stepping motor when the print head moves forward, providing a low level of torque with which to move the print head toward the platen. On the other hand, the motor driving circuit operates to slow down the rotation of the stepping motor when the print head moves away from the platen, providing a high level of torque with which to move the print head away from the platen.

7 Claims, 3 Drawing Sheets

PRINTER APPARATUS WITH AUTOMATIC GAP ADJUSTING MECHANISM

BACKGROUND OF THE INVENTION

The present invention relates to a printer apparatus which includes a mechanism for adjusting the gap between the surface of a print sheet and the print head.

Generally, in wire-dot printers, the print head is mounted on the carriage which moves in the axial direction of the platen. Printing is performed by pressing an ink ribbon against the paper by an impact from the print wires that extend from the print head.

In general, a printer does not always use the same thickness of paper, since different types of printing require the use of different thicknesses of paper. For example, when a multiple-part paper stock (a set of sheets arranged in layer-like fashion, with carbon paper placed between adjacent sheets, to obtain multiple printed copies) is used, it is necessary to adjust appropriately the gap between the surface of a print sheet and the print head, in accordance with the thickness of the paper placed on the platen.

A printer developed to accommodate differences in paper thickness is disclosed in U.S. Pat. No. 4,652,153, granted to Kotsuzumi et al., and in U.S. Pat. No. 4,676,675 granted to Suzuki et al. which adjust the gap automatically, according to the thickness of the paper placed on the platen. For printer apparatuses provided with this type of automatic gap-adjusting mechanism, the shaft supporting the carriage is mounted such that it is movable in the direction of the platen, and the size of the gap is changed by moving the shaft using a stepping motor. When paper is wrapped around the platen, the print head moves toward the platen, contacts the platen and moves back a specified distance, thereby obtaining a gap corresponding to the thickness of the paper. The stepping motor steps out when the print head, moving forward, contacts the platen. More specifically, the rotor of the stepping motor is caused to stop in spite of the changeover of the exciting phases.

In the case of printer apparatuses having an automatic gap adjusting mechanism, the same level of torque is produced by the stepping motor when the print head is moved toward the platen (forward movement) or moved away from the platen (backward movement). This phenomenon poses a number of problems, regardless of whether the torque is high or low. The problems in question will be described in detail in the following.

Assume that the print head is made to move forward perpendicularly to the platen by means of a high level of torque supplied by the stepping motor. In this case, even when the print head contacts the platen, the motor does not step out instantly, therefore the print head presses against part of the surface of the platen considerably before the motor steps out. This makes it impossible to obtain a precise gap.

Suppose that the torque of the stepping motor is set at a low level. In this case, when the print head moves and contacts the platen, the stepping motor steps out. The exciting phases of the stepping motor at this time must remain unchanged. However, since the surface of the platen is made of rubber, it exerts a reactive force when it receives an impact given from the print head. This reactive force causes improper exciting phases. In addition, when the print head moves backward, owing to the synergetic effect of the reactive force of the platen and the torque of the stepping motor, the exciting phases are further shifted incorrectly.

A four-phase stepping motor can be driven by two-phase excitation as is shown in FIG. 3. When the magnet rotor is positioned as shown in FIG. 1, signals S3, S4, S5 and S6 are applied to transistors Tr1 to Tr4, turning on these transistors. Hence, coils L1 and L4 are excited, causing a current to flow as is shown in FIG. 1, coils L1 and L4 function as electromagnets. Therefore, S poles occur in coils L1 and L4 at their sides facing the magnet rotor, in accordance with the right-hand thumb law. Consequently, the N pole of the rotor moves to the mid-point between coils L1 and L4. Then, signals S3, S4, S5 and S6 are applied to transistors Tr1 to Tr4, turning on transistors Tr1 and Tr2. As a result, coils L1 and L2 are excited, and S poles occur in coils L1 and L2 at their sides facing the magnet rotor. Consequently, the N pole of the magnet rotor moves to the mid-point between coils L1 and L2. Similarly, when transistors Tr2 and Tr3 are turned on, coils L2 and L3 are excited, and the N pole of the magnet rotor is positioned at the mid-point between coils L2 and L3; and when transistors Tr3 and Tr4 are turned on, coils L3 and L4 are excited, and the N pole of the magnet rotor moves to the mid-point between coils L3 and L4.

For a stepping motor which is driven by two-phase excitation as mentioned above, a central processing unit (CPU), for example, which supplies signals to change the exciting phase, checks the output signal of a photosensor, for example, which has detected the rotation of the stepping motor before the change of the exciting phase. After the rotation of the stepping motor becomes steady, the CPU changes the exciting phase to the next one.

Suppose that the print head contacts the platen when the exciting phase is changed from CD to DA during forward movement of the print head. The torque of the stepping motor is low at this time. The stepping motor steps out and the exciting phase is held at DA. Then, the exciting phase is shifted from, DA to CD, whereby the print head moves backward. Further, reactive force is applied from the platen. Both this reactive force and the torque of the head moving backward sometimes cause the magnet rotor to make nearly one rotation, resulting in an erroneous shift of about four phases.

Suppose that the print head contacts the platen when the exciting phase is changed from CD to DA during forward movement of the print head. The torque of the stepping motor is high in this case. Due to the high torque, the stepping motor does not step out but continues to rotate. The CPU changes the exciting phase from DA to AB. Therefore, the print head contacts the platen with an excessively great force, whereby the platen is depressed. This depression makes it impossible to obtain a precise gap. This is the disadvantage of printer apparatuses having the conventional automatic gap adjusting mechanism.

SUMMARY OF THE INVENTION

The object of this invention is to provide a printer apparatus having an automatic gap adjusting mechanism capable of setting a precise gap by varying the torque of a pulse motor, which is produced when the print head moves back and forth.

In order to achieve the above object, the printer apparatus of the present invention comprises a platen around which a sheet of paper or a multiple-part paper stock is wrapped, a print head for printing on the sheet of paper or the multiple-part paper stock wrapped around the platen, a carriage for supporting the print head in such a way that the print head moves toward or away from the platen, a stepping motor for moving the carriage toward or away from the platen, the stepping motor being rotated by a changeover of its exciting phases thereof, a driver device for driving the stepping, motor, and a driver control unit for controlling the driver device such that it drives the stepping motor with a first torque when moving the print head toward the platen and with a second torque, greater than the first torque, when moving the print head in the direction away from the platen.

In the printer apparatus having an automatic gap adjusting mechanism according to the present invention, the stepping motor can easily have an optimum torque value for moving the print head back and forth. Further, various torque values can be selected by a program, and the gap can be adjusted with high accuracy. The distance between the platen and the print head in the furthest position is longer than the distance between the print head contacting the platen and the position where the gap is adjusted. Therefore, the total gap-adjusting speed is determined by the speed at which the print head moves forward. Thus, according to this invention, a low torque is set for forward movement to thereby increase the speed of the stepping motor and the total gap-adjustment speed.

BRIEF DESCRIPTION OF THE INVENTION

Figure 5:
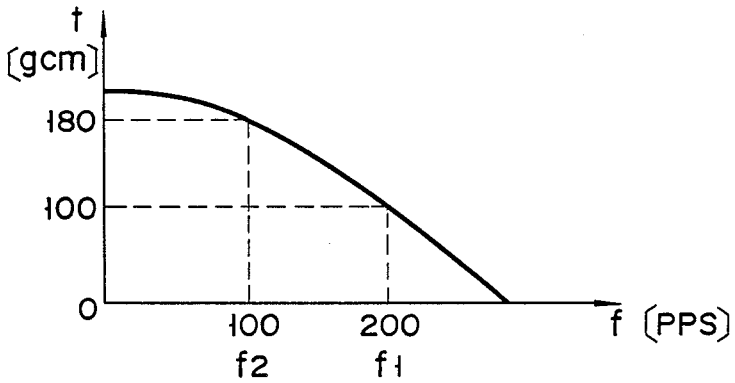
Figures 4A, 4B, 4C, 4D, 4E, 4F, 4G:
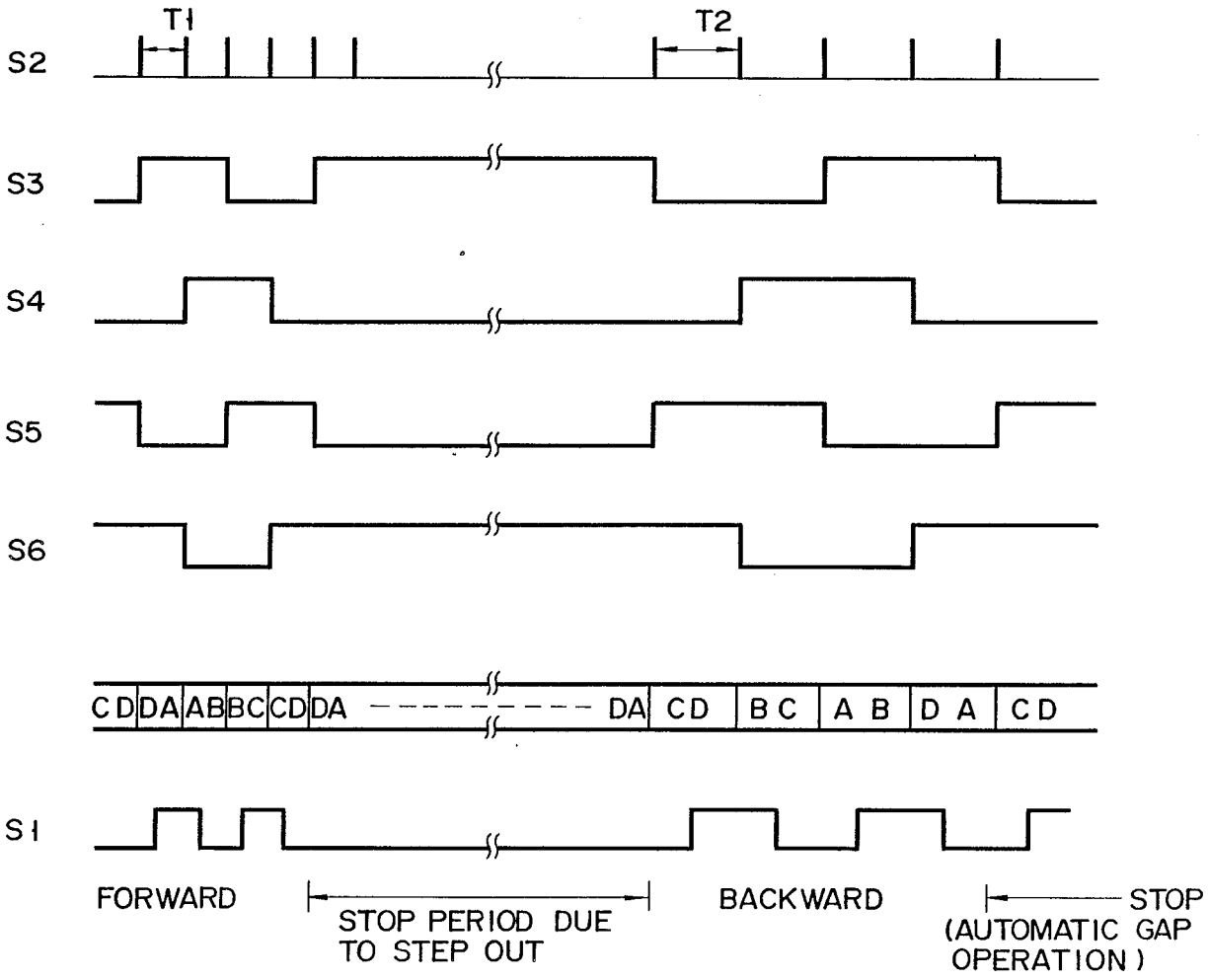

FIGS. 4A through 4G are timing charts explaining the operation of an embodiment of this invention, FIG. 4A showing interrupt signal S2 sent from the timer, FIGS. 4B to 4E showing signals S3, S4, S5 and S6 for exciting the coils of a pulse motor, FIG. 4F showing the two-phase excitation of a pulse motor, and FIG. 4G showing pulse signal S1 supplied from a sensor; and FIG. 5 shows rotating speed-torque characteristics of a pulse motor used in an embodiment of this invention.

DETAILED DESCRIPTION OF THE PREFERRED EMBODIMENT

Figure 2:
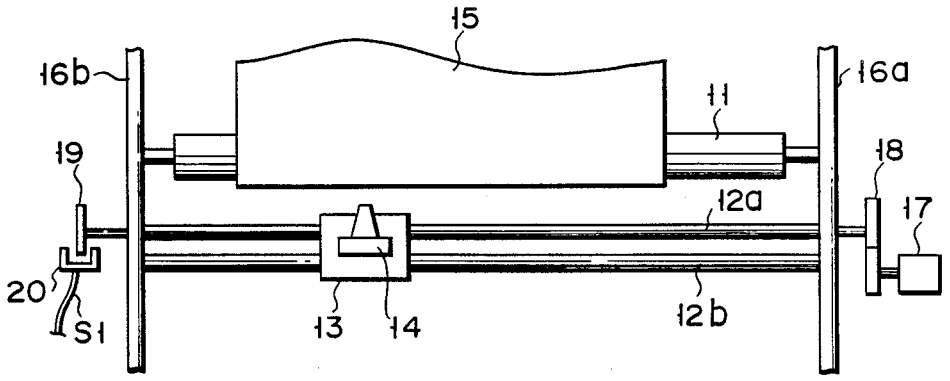
FIG. 2 (PRIOR ART)
FIG. 2 is a view showing the printing section of a printer apparatus in which an automatic gap adjusting mechanism of this invention is used.

FIG. 2 shows the printing mechanism of a printer apparatus having an automatic gap adjusting mechanism of this invention.

In this printing section, shafts 12*a* and 12*b* are provided in parallel with the axial direction of platen 11. Shaft 12*a* is inserted into a through hole provided on the front portion of carriage 13. Furthermore, shaft 12*b* is inserted in a U-shaped through hole in the rear portion of carriage 13. Accordingly, carriage 13 can move in the axial direction of platen 11. Print head 14 is mounted on carriage 13. As carriage 13 moves in the axial direction of platen 11, the print wires projected from carriage 13 impact paper 15 through an ink ribbon (not shown) to thereby print data on paper 15. Shaft 12*b* is mounted to side frames 16*a* and 16*b*. Shaft 12*a* is mounted to side frames 16*a* and 16*b* through an eccentric cam (not shown). In other words, shaft 12*a* is fixed to the eccentric position of a circular cam. The circular cam is rotatably mounted to side frames 16*a* and 16*b*. Gear 18 is mounted on one end of shaft 12*a*, and timing disk 19 is mounted on the other end of shaft 12*a*. When the rotation of stepping motor 17 is transmitted to the eccentric cam through gear 18, shaft 12*a* moves back and forth while rotating. As a result, carriage 13 moves in the direction perpendicular to the axial direction of platen 11. Timing disk 19 is also rotated along the rotation of shaft 12*a*. Photosensor 20 is provided beneath timing disk 19. Each time timing disk 19 is rotated, pulse signal S1 shown in FIG. 4G is output from photosensor 20.

Figure 3:
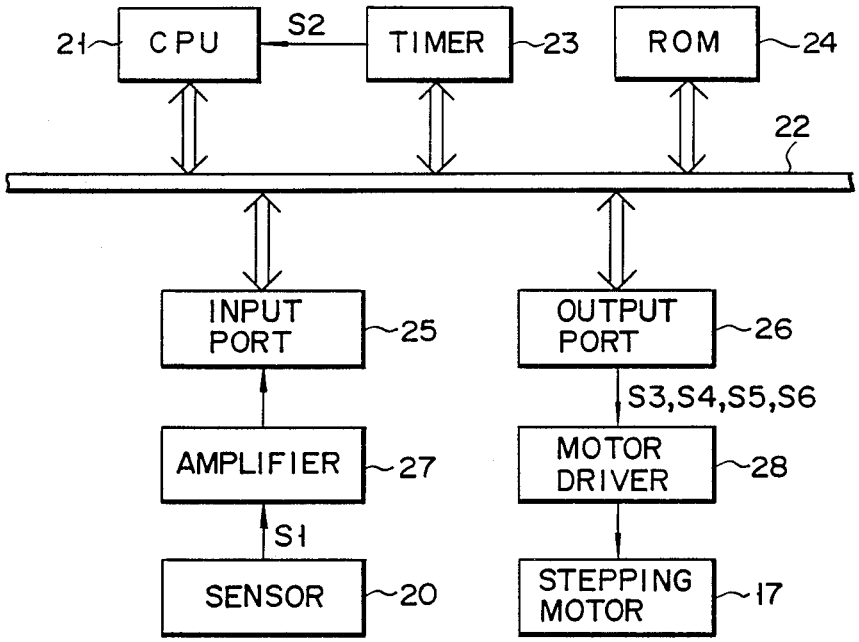
FIG. 3 is a block diagram showing a circuit for driving the printing section shown in FIG. 2.

FIG. 3 is a block diagram showing a circuit for driving the printing section (FIG. 2). This circuit comprises central processing unit (CPU) 21. CPU 21 consists of, for example, and 8-bit microprocessor Z80 made by Zilog Corp. of the United States, and controls the other components of the circuit. CPU 21 reads data from timer 23, read only memory (ROM) 24 and input port 25 through system bus 22. Input port 25 receives signals from sensor 20 through amplifier 27. CPU 21 can determine whether stepping motor 17 is rotating, from the signals supplied from input port 25. When stepping motor 17 is rotating, that is, when CPU 21 receives high-level signal S1 (FIG. 4G), CPU 21 shifts the exciting phase to the next phase. In other words, CPU 21 supplies exciting phase change-over signals S3 to S6 (FIGS. 4B to 4E) to motor driver 28 through output port 26. In response to these signals S3 through S6, motor driver 28 drives stepping motor 17. Read only memory (ROM) 24 stores a program for controlling CPU 21.

An embodiment of this invention will be described with reference to FIGS. 4A to 4G and FIG. 5.

Figure 1:
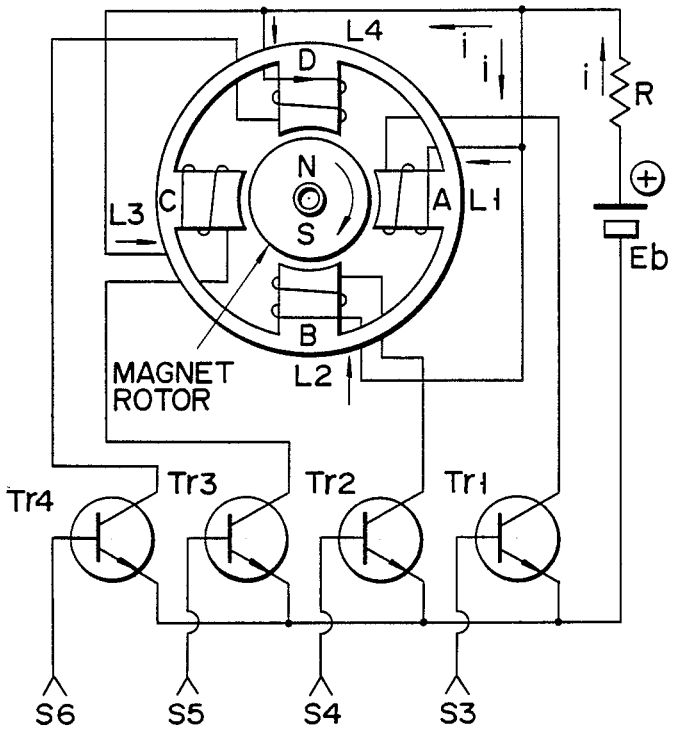
FIG. 1 (PRIOR ART)
FIG. 1 is a diagram explaining the operation of a conventional stepping motor.

To simplify explanation, description will be made of a case where a four-phase stepping motor of FIG. 1 is driven by exciting two phases. However, this invention is not restricted to this embodiment.

Before adjustment, the gap between the paper 15 and print head 14 is at a maximum. At this time, the CD phase of stepping motor 17 is executed, and then held. To make the print head move forward under this condition, CPU 21 sets, to timer 23, the pulse rate (period T1) of signal S2 of FIG. 4A, which is sent through the system bus 22. The value of period T1 is stored in ROM 24. Hence, timer 23 supplies a timeout signal to CPU 21 at the expiration of period T1. In response to the first pulse signal S2, CPU 21 supplies data of "1001" (logic "1" by signal S3, logic "0" by signal S4, logic "0" by signal S5 and logic "1" by signal S6), which is shown in FIGS. 4B to 4E, to motor driver 28 through output port 26. Consequently, motor driver 28 turns on transistors Tr1 to Tr4 (FIG. 1), thereby exciting coils L1 and L4. As shown in FIG. 4F, the DA phase of stepping motor 17 is excited. The N pole of magnet rotor is thus moved to the mid-point between coils L4 and L1.

Upon receipt of the second pulse signal S2 from timer 23, CPU 21 receives in signal S1 of FIG. 4G from sensor 20 through input port 25. If CPU 21 determines that the level of signal S1 is inverted from the previous level, it determines that stepping motor 17 has not stepped out. Then, CPU 21 supplies data of "1100" to motor driver 28, which turns on transistors Tr1 and Tr2. Therefore, coils L1 and L2 are excited, whereby the AB phase is excited as shown in FIG. 4F. Hence, the N pole of the magnet rotor is moved to the mid-point between coils L1 and L2.

Similarly, upon receipt of the third pulse signal, CPU 21 receives signal S1 from sensor 20 through input port 25 and determines whether or not the stepping motor 17 has stepped out. If it has not, CPU 21 supplies data of "0110" to motor driver 28. Motor driver 28 turns on transistors Tr2 and Tr3, thus exciting coils L2 and L3. Therefore, the BC phase is excited and the N pole of the magnet rotor is moved to the mid-point between coils L2 and L3.

Upon receipt of the fourth pulse signal S2, CPU 21 determines whether or not stepping motor 17 has stepped out. If it has not, CPU 21 supplies data of "0011" to motor driver 28, which accordingly turns on transistors Tr3 and Tr4. As a result, coils L3 and L4 are excited, thus exciting the CD phase of FIG. 4F. Hence, the N- pole of the magnet rotor is moved to the mid-point between L3 and L4.

In this manner, stepping motor 17 makes one rotation as two phases are excited, by turns, CD, DA, AB, BC and CD, for example.

The rotation of stepping motor 17 is transmitted to shaft 12 by means of gear 18 and eccentric cams (not shown). As a result, shaft 12 moves forward in a direction perpendicular to the axial direction of platen 11, thus gradually reducing the gap between paper 15 and print head 14. When print head 14 contacts paper 15 wrapped around platen 11, it is stopped at a position where the reactive force from platen 11 is balanced with the torque of stepping motor 17. In this embodiment, as shown in FIG. 4G, stepping motor 17 steps out when the DA phase is excited and signal S1 from sensor 20 falls to the low level. CPU 21 checks signal S1 supplied through input port 25 before it changes the exciting phase. Before changing the DA phase to the AB phase, CPU 21 determines whether or not stepping motor 17 has stepped out. Therefore, CPU 21 does not output control data to motor driver 28 for exciting phase change-over to the AB phase, instead the DA phase is held. At this time, the N pole of the magnet rotor is positioned somewhere between the midpoint of coils L3 and L4 and midpoint of coils L4 and L1.

Upon determining that the level of signal S1 remains unchanged from the previous level, CPU 21 sets period T2 (FIG. 4A) to timer 23. This period T2, like period T1, is stored in ROM 24. Period T2 is longer than period T1, therefore, stepping motor 17 is driven at a speed lower than when it moves forward. More specifically, when pulse signal S1 of period T2 is supplied from timer 23, CPU 21 supplies motor driver 28 with data of "0011". As a result, motor driver 28 turns on transistors Tr3 and Tr4. Coils L3 and L4 are excited, and the CD phase is excited as shown in FIG. 4F. Consequently, the N pole of the magnet rotor of stepping motor 17 is moved to the mid-point between coils L3 and L4, causing stepping motor 17 to rotate in the reverse direction. This rotation of stepping motor 17 is transmitted to shaft 12, making print head 14 move backward. Furthermore, as in the case of forward movement of the print head 14, the exciting phases are changed in sequence, moving print head 14 further backward. In this embodiment, CPU 21 supplies motor driver 28 with control data for stopping stepping motor 17 after changing the exciting phase to CD, BC, AB, DA and CD. Hence, print head 14 stops at a position where the optimum gap is suitable for the thickness of paper 15. Thus, automatic gap adjustment is completed.

When the rotating speed was increased by setting the pulse rate f1 (1/T1) of stepping motor 17 in forward movement at 200 pps (pulse per second), the torque of stepping motor 17 was 100 gcm as shown in FIG. 5. When the rotating speed was decreased by setting the pulse rate f2 (1/T2) in backward movement at 100 pps, the torque of stepping motor 17 was 180 gcm.

It is understood that the torque of stepping motor 17 is decreased by increasing the speed of motor 17 rotating forward, and is increased by decreasing the speed of motor 17 rotating backward. Therefore, by minimizing the impact of collision between print head 14 and platen 11 by decreasing the torque of motor 17, print head 14 can contact platen 11 such that the correct exciting phase is not displaced. Similarly, by making motor 17 less susceptible to the reactive force of platen 11, which is possible by increasing the torque of motor 17 rotating backward, the exciting phase of the stepping motor 17 can be prevented from being displaced.

What is claimed is:

1. A printer apparatus comprising:

a platen around which at least one sheet of paper is wrapped;

a print head for printing on said at least one sheet of paper wrapped around said platen;

a carriage for supporting said print head such that said print head can be moved toward and away from said platen;

a stepping motor for moving said carriage toward and away from said platen, said stepping motor being rotated by change-overs in exciting phases thereof;

driver means for driving said stepping motor;

pulse generating means for generating first pulses having a first pulse period of a first constant value and second pulses having a second pulse period of a second constant value which is larger than said first pulse period; and driver control means, responsive to said pulse generating means, for controlling said driver means such that when said first pulses are output by said pulse generating means, said driver means drives said stepping motor with a first torque when moving said print head toward said platen, and when said second pulses are output by said pulse generating means, said driver means drives said stepping motor with a second torque, greater than said first torque, when moving said print head away from said platen.

2. The printer apparatus according to claim 1, wherein said driver control means includes means for outputting an exciting phase change-over control signal to change the exciting phase of said stepping motor, and said driver control means controls said driver means to drive said stepping motor with said first and second torques, respectively, in response to said exciting phase change-over control signal from said means for outputting an exciting phase change-over control signal.

3. The printer apparatus according to claim 1, further comprising a sensor means for detecting step-out of said stepping motor, and wherein said driver control means drives said print head toward and away from said platen in response to an output signal from said sensor means during the movement of said platen toward said platen.

4. The printer apparatus according to claim 1, wherein said pulse generating means includes counting means for receiving pulse period data indicating the pulse period of said first and second pulses supplied to said driver control means, and for outputting said first and second pulses after completing a count operation in accordance with said pulse period data, first pulse period data being set in said counting means when moving said print head toward said platen, and second pulse period data, which is larger than said first pulse period data, is set in said counting means when moving said print head away from said platen.

5. The printer apparatus according to claim 4, further comprising a storage unit for storing said first and second pulse period data.

6. The printer apparatus according to claim 4, further comprising a sensor means for detecting step-out of said stepping motor, and wherein said driver control means drives said print head toward and away from said platen in response to an output signal from said sensor means during movement of said platen toward said platen.

7. A printer apparatus comprising:

a platen around which at least one sheet of paper is wrapped;

a print head for printing on said at least one sheet of paper wrapped around said platen;

a carriage for supporting said print head in such a way that said print head moves in a direction substantially orthogonal to an axis of said platen;

a stepping motor for moving said carriage in the direction substantially orthogonal to the axis of said platen, said stepping motor being rotated by a change-over of its exciting phases;

driver means for driving said stepping motor; and pulse generating means for generating a first pulse having a pulse period of a first constant value, and a second pulse having a pulse period of a second constant value larger than said first constant value; and driver control means for controlling said driver response to said first pulse, such that said driver means drives said stepping motor at a first speed when moving said print head toward said platen, and for controlling said driver means, in response to said second pulse, such that said driver means drives said stepping motor at a second speed, lower than said first speed, when moving said print head away from said platen.

* * * * *